US010332436B2

(12) United States Patent
Xu

(10) Patent No.: US 10,332,436 B2
(45) Date of Patent: Jun. 25, 2019

(54) LUMINANCE ADJUSTMENT SYSTEM

(71) Applicant: Shenzhen China Star Optoelectronics Semiconductor Display Technology Co., Ltd., Shenzhen (CN)

(72) Inventor: Jing Xu, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/570,381

(22) PCT Filed: Jul. 13, 2017

(86) PCT No.: PCT/CN2017/092729

§ 371 (c)(1),
(2) Date: Oct. 30, 2017

(87) PCT Pub. No.: WO2018/214252

PCT Pub. Date: Nov. 29, 2018

(65) Prior Publication Data

US 2018/0342189 A1 Nov. 29, 2018

(30) Foreign Application Priority Data

May 24, 2017 (CN) ..... 2017 1 0374673

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2320/0238* (2013.01);
(Continued)

(58) Field of Classification Search
None
See application file for complete search history.

(56) References Cited

U.S. PATENT DOCUMENTS 8,619,224 B2 12/2013 Chae
2004/0085477 A1* 5/2004 Majumder ..... H04N 9/12 348/383

(Continued)

FOREIGN PATENT DOCUMENTS

CN 103871358 A 6/2014
CN 105529002 A 4/2016

(Continued)

*Primary Examiner* — Xin Sheng
(74) *Attorney, Agent, or Firm* — Leong C. Lei

(57) ABSTRACT

The invention provides a luminance adjustment system, comprising: a block division module (1), a luminance representative value calculation module (2), an edge information extraction module (3), an adjustment gain calculation module (4), a gain smooth processing module (5), and a data modulation module (6). By dividing an image into blocks, and combined with the luminance representative value and the amount of edge information amount indicating the complexity of the image of each block, the invention performs an individual luminance adjustment on each block, so that a more accurate adjustment can be achieved. As such, the invention can maintain details in darker part of the image, and to adjust the luminance of bright and complex part of the image to a greater extent.

12 Claims, 5 Drawing Sheets

(52) U.S. Cl.
CPC . *G09G 2320/043* (2013.01); *G09G 2320/066* (2013.01); *G09G 2320/0626* (2013.01); *G09G 2320/0686* (2013.01); *G09G 2340/06* (2013.01); *G09G 2360/16* (2013.01)

(56) References Cited

U.S. PATENT DOCUMENTS

| | | | | |
|---|---|---|---|---|
| 2009/0116713 | A1* | 5/2009 | Yan | G06K 9/4619 382/128 |
| 2011/0050934 | A1* | 3/2011 | Mitsunaga | H04N 1/58 348/222.1 |
| 2017/0011272 | A1* | 1/2017 | Barton | G06K 9/18 |

FOREIGN PATENT DOCUMENTS

| | | | |
|---|---|---|---|
| CN | 106205488 | A | 12/2016 |
| CN | 1892311 | A | 1/2017 |
| WO | WO2016072129 | A1 | 5/2016 |

* cited by examiner

LUMINANCE ADJUSTMENT SYSTEM

BACKGROUND OF THE INVENTION

1. Field of the Invention

The present invention relates to the field of display techniques, and in particular to a luminance adjustment system.

2. The Related Arts

The panel display device provides the advantages of thinness, power-saving, radiation-free, and so on, and is widely applied to various fields. The known panel display device mainly comprises liquid crystal display (LCD) and organic light-emitting diode (OLED) display.

The OLED display provides the advantages of active light-emitting, need for backlight source, low driving voltage, high illumination efficiency, quick response time, high clearness and contrast, near 180° viewing angle, wide operation temperature range, applicable to flexible panel and large-area full-color display, and is regarded as the most promising display technology.

The OLED display comprises a plurality of pixels arranged in an array, with each pixel comprising: a red sub-pixel (R), a green sub-pixel (G), and a blue sub-pixel (B), and each sub-pixel disposed with an OLED. The OLED usually comprises: an anode, a hole injection layer disposed on the anode, a hole transport layer disposed on the hole injection layer, an organic light-emitting layer disposed on the hole transport layer, an electron transport layer disposed on the organic light-emitting layer, an electron injection layer disposed on the electron transport layer, and a cathode disposed on the electron injection layer. The operation theory of the OLED display is that the semiconductor material and the organic light-emitting material driven by the electrical field to emit light through carrier injection and combination.

At present, the OLED display ageing and power-consumption problems are more prominent. In known technique, an approach to address the OLED display ageing and power-consumption problems is:

Using average picture level (APL) algorithm to compute the luminance intensity of the display screen. If the screen has too high a luminance intensity, the overall luminance is reduced by adjusting data signal, gamma voltage, or OLED voltage, which achieves reducing OLED power-consumption as well as slowing down OLED ageing.

However, the above approach has a shortcoming: for high luminance intensity images with high luminance contrast, the overall image luminance will be reduced to cause the contrast also reduced, as well as losing the details in darker part of the image, resulting in degraded display quality.

SUMMARY OF THE INVENTION

The object of the present invention is to provide a luminance adjustment system, able to maintain details in darker part of the image, and to adjust the luminance of bright and complex part of the image to a greater extent.

To achieve the above object, the present invention provides a luminance adjustment system, comprising:

a block division module, for receiving original image data and dividing image into M×N blocks along X-direction and Y-direction; wherein, M and N both positive integers; each block comprising a plurality of pixels arranged in an array, the original image data of each pixel comprising: red original image data, green original image data, and blue original image data;

a luminance representative value calculation module electrically connected to the block division module, for obtaining a luminance representative value for each block;

an edge information extraction module electrically connected to the block division module, for analyzing the original image data of each block to obtain an edge information amount of each block;

an adjustment gain calculation module electrically connected to the luminance representative value calculation module and the edge information extraction module, for calculating a luminance adjustment coefficient of each block based on the luminance representative value and the edge information amount of each block;

a gain smooth processing module electrically connected to the adjustment gain calculation module, for performing calibration the luminance adjustment coefficient of each block to obtain a luminance adjustment calibration value of each block so as to performing smooth processing on each pixel in each block to prevent luminance at borders between blocks from mutating; and a data modulation module electrically connected to the gain smooth processing module, for performing modulation on the original image data based on the luminance adjustment calibration value of each block to obtain a modulated image data of each block so as to perform individual luminance modulation on each block.

According to a preferred embodiment of the present invention, the luminance representative value calculation module obtains the luminance representative value of each block as follows:

obtaining a luminance feature value TBP of each pixel in a block; and calculating an average of the luminance feature values TBP of all the pixels in the block as the luminance representative value (average picture level, APL) of the block.

Optionally, the luminance representative value calculation module obtains the luminance feature value TBP of each pixel in the block as follows:

extracting a maximum luminance value corresponding to the red original image data, green original image data, and blue original image data of a pixel as the luminance feature value TBP, i.e.:

$$TBP=\mathrm{Max}(R,G,B).$$

Optionally, the luminance representative value calculation module obtains the luminance feature value TBP of each pixel in the block as follows:

translating the red original image data, green original image data, and blue original image data of a pixel to YCbCr color space, and then calculating the luminance feature value TBP with the following:

$$TBP=0.299R+0.587G+0.114B.$$

According to a preferred embodiment of the present invention, the edge information extraction module uses Sobel operator for edge detection to obtain the edge information amount of each block.

According to a preferred embodiment of the present invention, the edge information extraction module obtains the edge information amount of each block as follows:

first, calculating an X-direction grayscale value $G_x$ and a Y-direction grayscale $G_Y$ of each pixel in a block:

$$G_X=\mathrm{Sobel}_X\times f(a,b);$$

$$G_Y=\mathrm{Sobel}_Y\times f(a,b);$$

wherein f(a,b) is the luminance value of the original image data corresponding to the pixel with X-direction coordinate a and Y-direction coordinate b in the block, $Sobel_X$ is an X-direction Sobel operator and $Sobel_Y$ is a Y-direction Soble operator;

then, calculating a gradient G of each pixel in the block:

$$G=\sqrt{G_X^2+G_Y^2};$$

then, comparing the gradient G of each pixel in the block with a default threshold; if the gradient G of a pixel being greater than the default threshold, determining the pixel as an edge point;

finally, summing the number of the pixels determined as edge points in the block as the edge information amount of the block.

According to a preferred embodiment of the present invention, each block comprises 3×3 pixels, the X-direction Sobel operator $Sobel_X$ and Y-direction Soble operator $Sobel_Y$ are respectively as:

$$Sobel_X=\begin{bmatrix}-1 & 0 & +1\\ -2 & 0 & +2\\ -1 & 0 & +1\end{bmatrix}$$

$$Sobel_Y=\begin{bmatrix}+1 & +2 & +1\\ 0 & 0 & 0\\ -1 & -2 & -1\end{bmatrix}$$

According to a preferred embodiment of the present invention, the adjustment gain calculation module calculates the luminance adjustment coefficient of each block as follows:

first, presetting a target luminance for grayscale 255 at different luminance representative value APL so that the target luminance decreasing as the grayscale corresponding to the luminance representative value increasing, calculating a normal luminance adjustment coefficient $K_{APL}$ of each block as following:

$$K_{APL}=\text{target luminance/luminance before adjustment};$$

presetting a relation between the edge information amount and an edge luminance adjustment coefficient $K_{edge}$, so that the edge luminance adjustment coefficient $K_{edge}$ decreasing as the edge information amount increasing, looking for the corresponding edge luminance adjustment coefficient $K_{edge}$ based on the edge information amount of each block;

then, calculating the luminance adjustment coefficient K as following:

$$K=K_{APL}\times K_{edge}.$$

According to a preferred embodiment of the present invention, the gain smooth processing module performs calibration on the luminance adjustment coefficient of each block as follows:

first, selecting a block, calculating a horizontal gain $K_H$ of an X-direction adjacent block, and a vertical gain $K_V$ of a Y-direction adjacent block for the selected block as following:

$$K_H=K_1+(K_2-K_1)\times x/X;$$

$$K_V=K_1+(K_3-K_1)\times y/Y;$$

wherein $K_1$ is the luminance adjustment coefficient of the selected block, $K_2$ is the luminance adjustment coefficient of X-direction adjacent block of the selected block, $K_3$ is the luminance adjustment coefficient of Y-direction adjacent block of the selected block, x and y are X-direction and Y-direction coordinates of each pixel with respect to a center pixel of the selected block, X is the horizontal distance between the center pixel of the selected block and the center pixel of the X-direction adjacent block, and Y is the vertical distance between the center pixel of the selected block and the center pixel of the Y-direction adjacent block;

then, calculating the luminance adjustment calibration value K' of each pixel in the selected block as following:

$$K'=(K_H+K_V)/2.$$

According to a preferred embodiment of the present invention, the data modulation module obtains the modulated image data of each block as follows:

the modulated image data of a block=the luminance adjustment calibration value K' of each pixel in the block× the original image data of the corresponding pixel in the block, i.e.:

$$R'=K'\times R;$$

$$G'=K'\times G;$$

$$B'=K'\times B;$$

wherein R', G', and B' are modulated red image data, modulated green image data, and modulated blue image data respectively.

The present invention also provides a luminance adjustment system, comprising:

a block division module, for receiving original image data and dividing image into M×N blocks along X-direction and Y-direction; wherein, M and N both positive integers; each block comprising a plurality of pixels arranged in an array, the original image data of each pixel comprising: red original image data, green original image data, and blue original image data;

a luminance representative value calculation module electrically connected to the block division module, for obtaining a luminance representative value for each block;

an edge information extraction module electrically connected to the block division module, for analyzing the original image data of each block to obtain an edge information amount of each block;

an adjustment gain calculation module electrically connected to the luminance representative value calculation module and the edge information extraction module, for calculating a luminance adjustment coefficient of each block based on the luminance representative value and the edge information amount of each block;

a gain smooth processing module electrically connected to the adjustment gain calculation module, for performing calibration the luminance adjustment coefficient of each block to obtain a luminance adjustment calibration value of each block so as to performing smooth processing on each pixel in each block to prevent luminance at borders between blocks from mutating; and a data modulation module electrically connected to the gain smooth processing module, for performing modulation on the original image data based on the luminance adjustment calibration value of each block to obtain a modulated image data of each block so as to perform individual luminance modulation on each block;

wherein the luminance representative value calculation module obtains the luminance representative value of each block as follows:

obtaining a luminance feature value TBP of each pixel in a block; and calculating an average of the luminance feature values TBP of all the pixels in the block as the luminance representative value (average picture level, APL) of the block;

wherein the edge information extraction module uses Sobel operator for edge detection to obtain the edge information amount of each block;

wherein the edge information extraction module obtains the edge information amount of each block as follows:

first, calculating an X-direction grayscale value $G_x$ and a Y-direction grayscale $G_Y$ of each pixel in a block:

$$G_X = \text{Sobel}_X \times f(a,b);$$

$$G_Y = \text{Sobel}_Y \times f(a,b);$$

wherein f(a,b) is the luminance value of the original image data corresponding to the pixel with X-direction coordinate a and Y-direction coordinate b in the block, $\text{Sobel}_X$ is an X-direction Sobel operator and $\text{Sobel}_Y$ is a Y-direction Soble operator;

then, calculating a gradient G of each pixel in the block:

$$G = \sqrt{G_X^2 + G_Y^2};$$

then, comparing the gradient G of each pixel in the block with a default threshold; if the gradient G of a pixel being greater than the default threshold, determining the pixel as an edge point;

finally, summing the number of the pixels determined as edge points in the block as the edge information amount of the block;

wherein each block comprises 3×3 pixels, the X-direction Sobel operator $\text{Sobel}_X$ and Y-direction Soble operator $\text{Sobel}_Y$ are respectively as:

$$Sobel_X = \begin{bmatrix} -1 & 0 & +1 \\ -2 & 0 & +2 \\ -1 & 0 & +1 \end{bmatrix}$$

$$Sobel_Y = \begin{bmatrix} +1 & +2 & +1 \\ 0 & 0 & 0 \\ -1 & -2 & -1 \end{bmatrix}$$

wherein the adjustment gain calculation module calculates the luminance adjustment coefficient of each block as follows:

first, presetting a target luminance for grayscale 255 at different luminance representative value APL so that the target luminance decreasing as the grayscale corresponding to the luminance representative value increasing, calculating a normal luminance adjustment coefficient $K_{APL}$ of each block as following:

$$K_{APL} = \text{target luminance/luminance before adjustment};$$

presetting a relation between the edge information amount and an edge luminance adjustment coefficient $K_{edge}$, so that the edge luminance adjustment coefficient $K_{edge}$ decreasing as the edge information amount increasing, looking for the corresponding edge luminance adjustment coefficient $K_{edge}$ based on the edge information amount of each block;

then, calculating the luminance adjustment coefficient K as following:

$$K = K_{APL} \times K_{edge}.$$

Compared to the known techniques, the present invention provides the following advantages. The present invention provides a luminance adjustment system, by dividing an image into blocks, and combined with the luminance representative value and the amount of edge information amount indicating the complexity of the image of each block, to perform an individual luminance adjustment on each block, so that a more accurate adjustment can be achieved. As such, the present invention can maintain details in darker part of the image, and to adjust the luminance of bright and complex part of the image to a greater extent.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
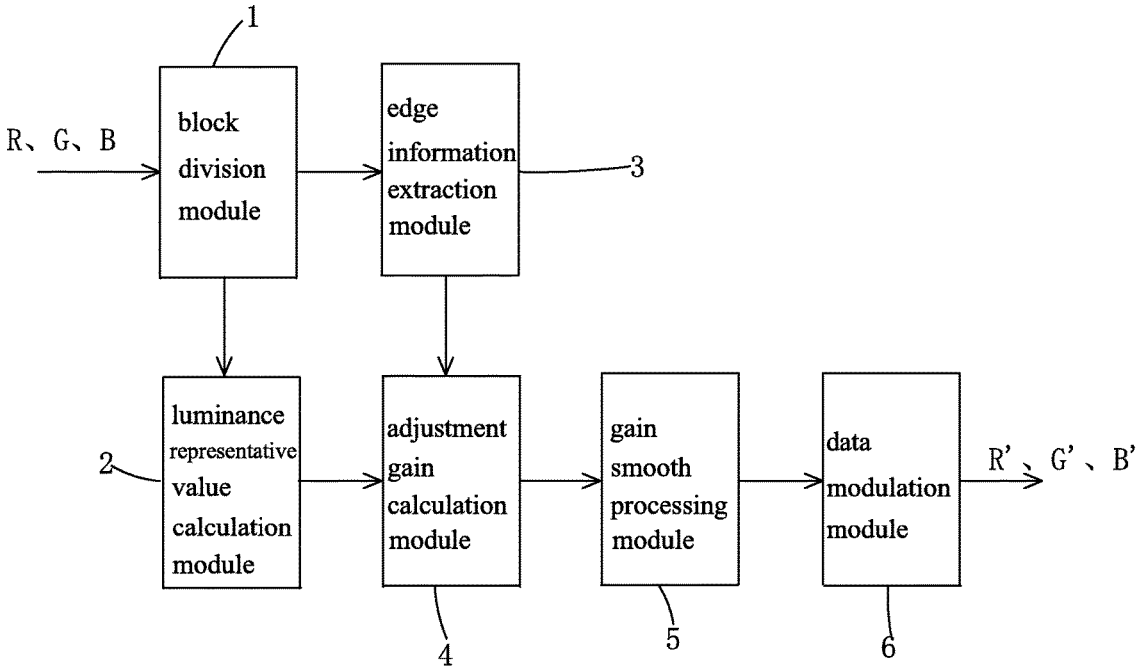
FIG. 1 is a schematic view showing a block diagram of the luminance adjustment system according to the present invention.

Referring to FIG. 1, the present invention provides a luminance adjustment system, comprising: a block division module 1, a luminance representative value calculation module 2 electrically connected to the block division module 1, an edge information extraction module 3 electrically connected to the block division module 1, an adjustment gain calculation module 4 electrically connected to the luminance representative value calculation module 2 and the edge information extraction module 3, a gain smooth processing module 5 electrically connected to the adjustment gain calculation module 4, and a data modulation module 6 electrically connected to the gain smooth processing module 5.

Figure 2:
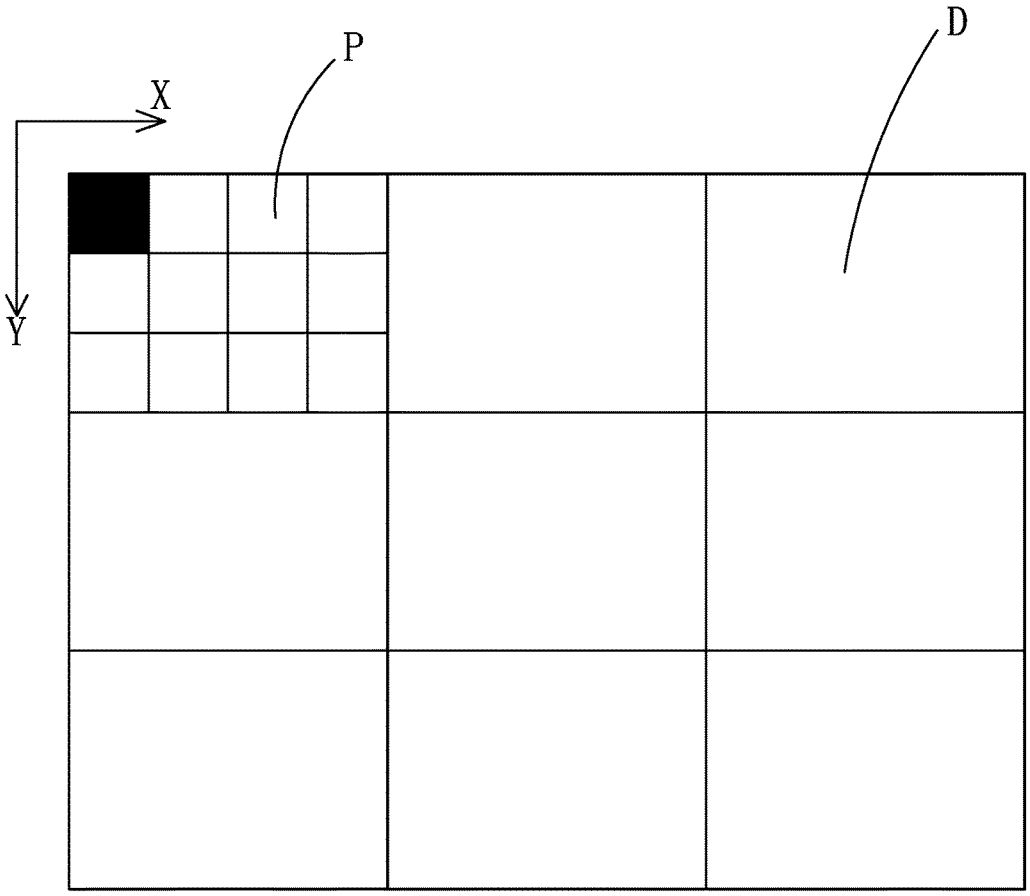
FIG. 2 is a schematic view showing the block division module of the luminance adjustment system dividing a frame into blocks according to the present invention.

Refer to FIG. 1 and FIG. 2. The block division module 1 is for receiving original image data and dividing image into M×N blocks D along X-direction and Y-direction; wherein, M and N both are positive integers; each block D comprises a plurality of pixels P arranged in an array, and the original image data of each pixel P comprises: red original image data R, green original image data G, and blue original image data B.

The luminance representative value calculation module 2 is for obtaining a luminance representative value for each block D.

Specifically, the luminance representative value calculation module 2 obtains the luminance representative value of each block D as follows:

First, obtaining a luminance feature value TBP of each pixel P in a block D.

Moreover, using one of the following two approaches to obtain the luminance feature value TBP of each pixel P in a block D:

1. extracting a maximum luminance value corresponding to the red original image data R, green original image data G, and blue original image data B of a pixel P as the luminance feature value TBP, i.e.:

$$TBP=\mathrm{Max}(R,G,B);$$

2. translating the red original image data R, green original image data G, and blue original image data B of a pixel P to YCbCr color space, and then calculating the luminance feature value TBP with the following:

$$TBP=0.299R+0.587G+0.114B.$$

Then, calculating an average of the luminance feature values TBP of all the pixels P in the block D as the luminance representative value (average picture level, APL) of the block.

The edge information extraction module 3 is for analyzing the original image data of each block D to obtain an edge information amount of each block D.

Specifically, the edge information extraction module 3 uses Sobel operator for edge detection. Take each block comprising 3×3 pixels P as example. The X-direction Sobel operator $\mathrm{Sobel}_X$ and Y-direction Soble operator $\mathrm{Sobel}_Y$ are respectively as:

$$Sobel_X=\begin{bmatrix}-1 & 0 & +1\\ -2 & 0 & +2\\ -1 & 0 & +1\end{bmatrix}$$

$$Sobel_Y=\begin{bmatrix}+1 & +2 & +1\\ 0 & 0 & 0\\ -1 & -2 & -1\end{bmatrix}$$

If A is an original image of a block D, the image of X-direction edge detection is:

$$\begin{bmatrix}-1 & 0 & +1\\ -2 & 0 & +2\\ -1 & 0 & +1\end{bmatrix}\times A$$

and the image of Y-direction edge detection is:

$$\begin{bmatrix}+1 & +2 & +1\\ 0 & 0 & 0\\ -1 & -2 & -1\end{bmatrix}\times A$$

Moreover, the edge information extraction module 3 obtains the edge information amount of each block D as follows:

First, calculating an X-direction grayscale value $G_x$ and a Y-direction grayscale $G_Y$ of each pixel P in a block D:

$$G_X=\mathrm{Sobel}_X\times f(a,b);$$

$$G_Y=\mathrm{Sobel}_Y\times f(a,b);$$

wherein f(a,b) is the luminance value of the original image data corresponding to the pixel P with X-direction coordinate a and Y-direction coordinate b in the block D; taking each block D comprising 3×3 pixels P as example, then:

$$G_X=(-1)\times f(x-1,y-1)+0\times f(x,y-1)+1\times f(x+1,y-1)+(-2)\times f(x-1,y)+0\times f(x,y)+2\times f(x+1,y)+(-1)\times f(x-1,y+1)+0\times f(x,y+1)+1\times f(x+1,y+1)$$

$$G_Y=1\times f(x-1,y-1)+2\times f(x,y-1)+1\times f(x+,y=1)+0\times f(x-1,y)+0\times f(x,y)+0\times f(x+1,y)+(-1)\times f(x-1,y+1)+(-2)\times f(x,y+1)+(-1)\times f(x+1,y+1)$$

Then, calculating a gradient G of each pixel P in the block D:

$$G=\sqrt{G_X^2+G_Y^2}$$

Then, comparing the gradient G of each pixel P in the block D with a default threshold; if the gradient G of a pixel being greater than the default threshold, determining the pixel as an edge point;

Finally, summing the number of the pixels P determined as edge points in the block D as the edge information amount of the block D. The edge information amount indicates the image complexity. The higher the edge information amount is, the more complex the image is.

The adjustment gain calculation module 4 is for calculating a luminance adjustment coefficient of each block D based on the luminance representative value and the edge information amount of each block D.

Figure 3:
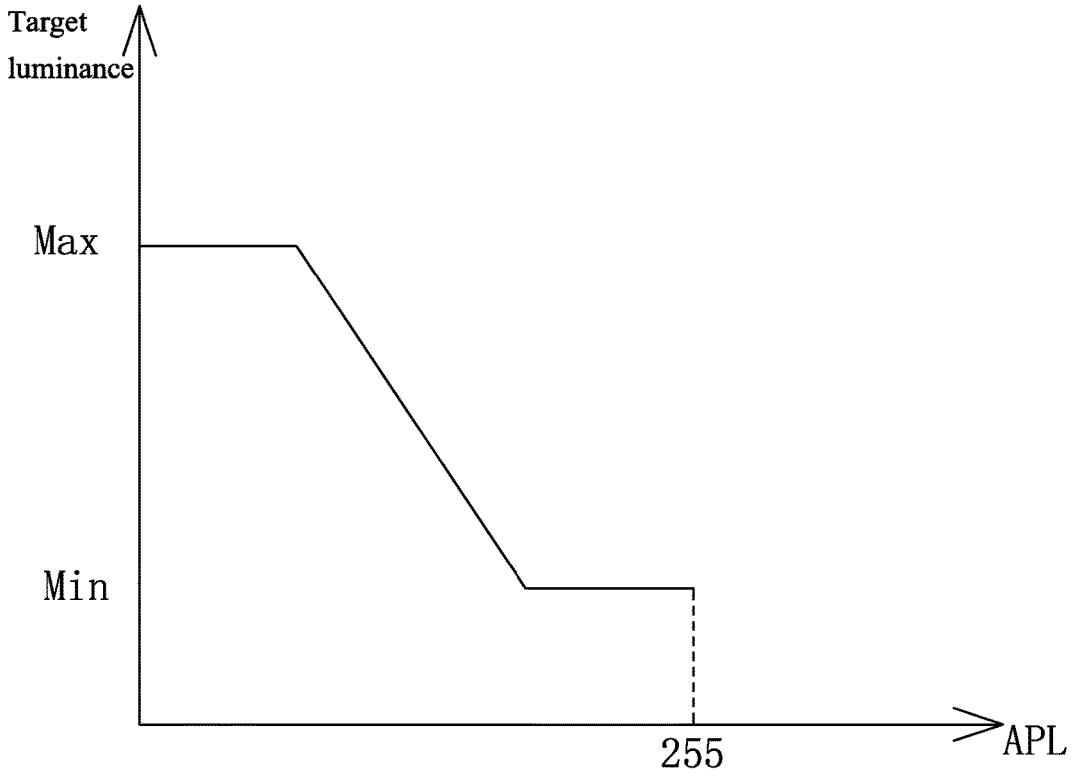
FIG. 3 is a schematic view showing the adjustment gain calculation module of the luminance adjustment system presetting target luminance for grayscale 255 under different luminance representative value APL according to the present invention.

Specifically, the adjustment gain calculation module 4 calculates the luminance adjustment coefficient of each block D as follows:

First, as shown in FIG. 3, presetting a target luminance for 255 grayscale 255 at different luminance representative value APL, calculating a normal luminance adjustment coefficient $K_{APL}$ of each block D as following:

$$K_{APL}=\text{target luminance/luminance before adjustment};$$

For example, assuming that the luminance of a block D before adjustment is grayscale 255, the luminance representative value APL is 255. On the condition that the luminance representative value APL is 255, the target luminance of grayscale 255 is Min=64. Then, $$K_{APL}=64/255=0.25;$$

Figure 4:
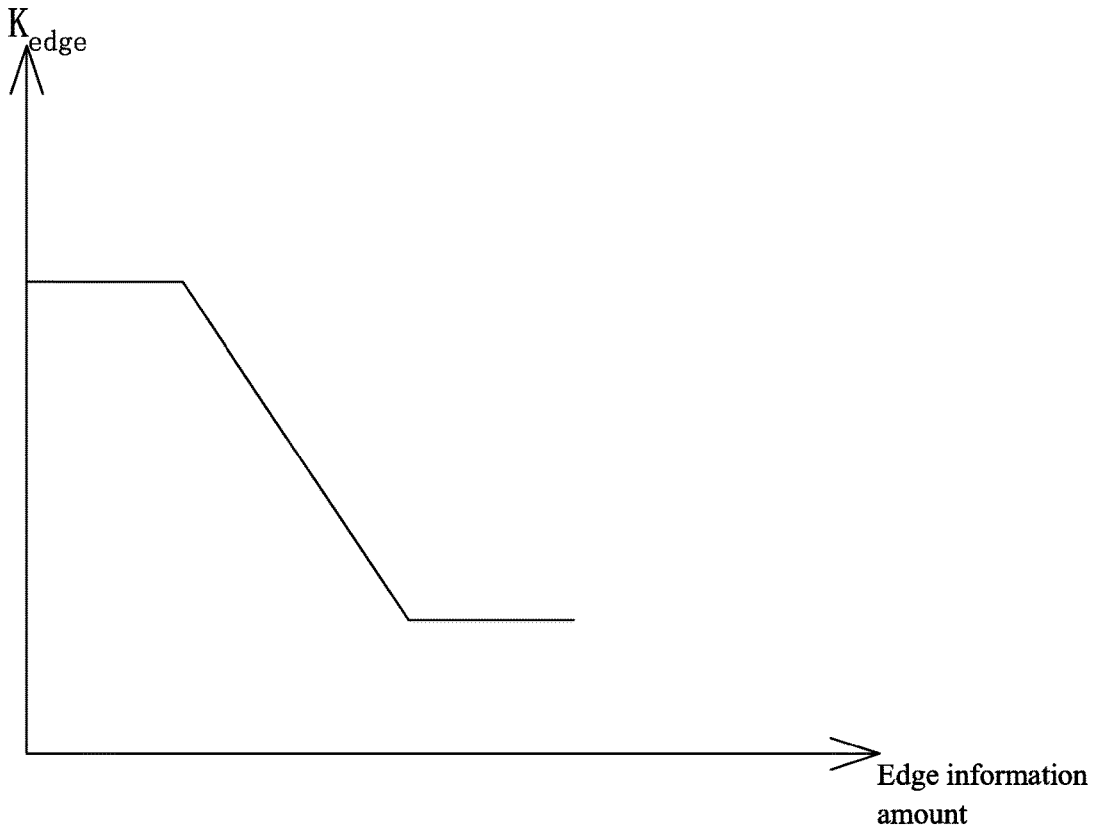
FIG. 4 is a schematic view showing the adjustment gain calculating module of the luminance adjustment system presetting the relation between edge information amount and edge luminance adjustment coefficient $K_{edge}$ according to the present invention.

Then, as shown in FIG. 4, presetting a relation between the edge information amount and an edge luminance adjustment coefficient $K_{edge}$, looking for the corresponding edge luminance adjustment coefficient $K_{edge}$ based on the edge information amount of each block D;

Then, calculating the luminance adjustment coefficient K as following:

$$K=K_{APL}\times K_{edge}.$$

It should be noted that the target luminance for grayscale 255 decreases as the grayscale corresponding to the luminance representative value increases. That is, the higher the grayscale corresponding to the luminance representative value APL is, the lower the target luminance for grayscale 255 is. The edge luminance adjustment coefficient $K_{edge}$ decreases as the edge information amount increases. That is, the larger the edge information amount is, the image is more complex, the lower the luminance is adjusted to so as to match the property that human eyes are more sensitive to complex image at lower luminance. Therefore, the luminance of complex image block D is adjusted to a greater extent.

The gain smooth processing module 5 is for performing calibration the luminance adjustment coefficient of each block D to obtain a luminance adjustment calibration value of each block D so as to performing smooth processing on each pixel P in each block D to prevent luminance at borders between blocks D from mutating.

Figure 5:
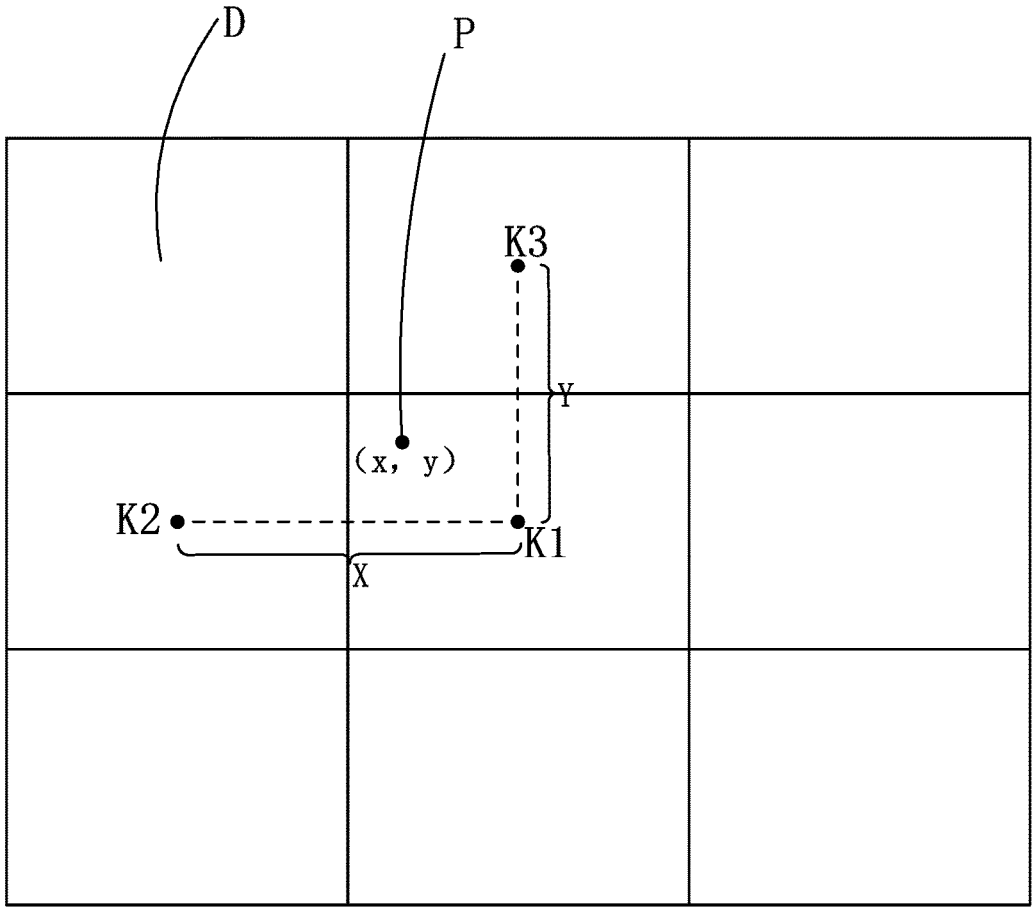
FIG. 5 is a schematic view showing the gain smooth processing module of the luminance adjustment system performing calibration on the luminance adjustment coefficient of each block according to the present invention.

Specifically, as shown in FIG. 5, the gain smooth processing module 5 performs calibration on the luminance adjustment coefficient of each block D as follows:

First, selecting a block D, calculating a horizontal gain $K_H$ of an X-direction adjacent block D, and a vertical gain $K_V$ of a Y-direction adjacent block D for the selected block D as following:

$$K_H=K_1+(K_2-K_1)\times x/X;$$

$$K=K_1+(K_3-K_1)\times y/Y;$$

wherein $K_1$ is the luminance adjustment coefficient of the selected block D, $K_2$ is the luminance adjustment coefficient of X-direction adjacent block D of the selected block D, $K_3$ is the luminance adjustment coefficient of Y-direction adjacent block D of the selected block D, x and y are X-direction and Y-direction coordinates of each pixel P with respect to a center pixel P of the selected block D, X is the horizontal distance between the center pixel P of the selected block D and the center pixel P of the X-direction adjacent block D, and Y is the vertical distance between the center pixel P of the selected block D and the center pixel P of the Y-direction adjacent block D;

Then, calculating the luminance adjustment calibration value K' of each pixel P in the selected block D as following:

$$K'=(K_H+K_V)/2.$$

The data modulation module electrically 6 is for performing modulation on the original image data based on the luminance adjustment calibration value of each block D to obtain a modulated image data of each block D so as to perform individual luminance modulation on each block D.

Specifically, the data modulation module 6 obtains the modulated image data of each block as follows:

the modulated image data of a block D=the luminance adjustment calibration value K' of each pixel P in the block D× the original image data of the corresponding pixel P in the block D, i.e.:

$$R'=K'\times R;$$

$$G'=K'\times G;$$

$$B'=K'\times B;$$

wherein R', G', and B' are modulated red image data, modulated green image data, and modulated blue image data respectively.

Therefore, the luminance adjustment system of the present invention can, by dividing an image into blocks, and combining with the luminance representative value and the amount of edge information amount indicating the complexity of the image of each block, perform an individual luminance adjustment on each block, so that a more accurate adjustment can be achieved. As such, the present invention can maintain details in darker part of the image, and to adjust the luminance of bright and complex part of the image to a greater extent.

In summary, the present invention provides a luminance adjustment system, by dividing an image into blocks, and combined with the luminance representative value and the amount of edge information amount indicating the complexity of the image of each block, to perform an individual luminance adjustment on each block, so that a more accurate adjustment can be achieved. As such, the present invention can maintain details in darker part of the image, and to adjust the luminance of bright and complex part of the image to a greater extent.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A luminance adjustment method, comprising:

receiving original image data and dividing image into M×N blocks in X-direction and Y-direction; wherein M and N are both positive integers; each block comprising a plurality of pixels arranged in an array, the original image data of each pixel comprising: red original image data, green original image data, and blue original image data;

obtaining a luminance representative value for each block;

analyzing the original image data of each block to obtain an edge information amount of each block;

calculating a luminance adjustment coefficient of each block based on the luminance representative value and the edge information amount of each block;

performing calibration of the luminance adjustment coefficient of each block to obtain a luminance adjustment calibration value of each block so as to performing smooth processing on each pixel in each block to prevent luminance at borders between blocks from mutating; and performing modulation on the original image data based on the luminance adjustment calibration value of each block to obtain a modulated image data of each block so as to perform individual luminance modulation on each block;

wherein Sobel operator is used for edge detection to obtain the edge information amount of each block;

wherein the edge information amount of each block is obtained as follows:

calculating an X-direction grayscale value $G_x$ and a Y-direction grayscale $G_Y$ of each pixel in a block:

$$G_X=\text{Sobel}_X\times f(a,b);$$

$$G_Y=\text{Sobel}_Y\times f(a,b);$$

wherein f(a,b) is the luminance value of the original image data corresponding to the pixel with X-direction coordinate a and Y-direction coordinate b in the block, $Sobel_X$ is an X-direction Sobel operator and $Sobel_Y$ is a Y-direction Soble operator;

calculating a gradient G of each pixel in the block:

$$G=\sqrt{G_X^2+G_Y^2};$$

comparing the gradient G of each pixel in the block with a default threshold; if the gradient G of a pixel being greater than the default threshold, determining the pixel as an edge point; and summing the number of the pixels determined as edge points in the block as the edge information amount of the block; and wherein the luminance adjustment coefficient of each block is calculated as follows:

presetting a target luminance for grayscale 255 at different luminance representative value APL so that the target luminance decreasing as the grayscale corresponding to the luminance representative value increasing, calculating a normal luminance adjustment coefficient $K_{APL}$ of each block as follows:

$$K_{APL}=\text{target luminance/luminance before adjustment};$$

presetting a relation between the edge information amount and an edge luminance adjustment coefficient $K_{edge}$, so that the edge luminance adjustment coefficient $K_{edge}$ decreasing as the edge information amount increasing, looking for the corresponding edge luminance adjustment coefficient $K_{edge}$ based on the edge information amount of each block; and calculating the luminance adjustment coefficient K as follows:

$$K=K_{APL}\times K_{edge}.$$

2. The luminance adjustment method as claimed in claim 1, wherein the luminance representative value of each block is obtained as follows:

obtaining a luminance feature value TBP of each pixel in a block; and calculating an average of the luminance feature values TBP of all the pixels in the block as the luminance representative value (average picture level, APL) of the block.

3. The luminance adjustment method as claimed in claim 2, wherein the luminance feature value TBP of each pixel in the block is obtained as follows:

extracting a maximum luminance value corresponding to the red original image data, green original image data, and blue original image data of a pixel as the luminance feature value TBP, which is:

$$TBP=\text{Max}(R,G,B).$$

4. The luminance adjustment method as claimed in claim 2, wherein the luminance feature value TBP of each pixel in the block is obtained as follows:

translating the red original image data, green original image data, and blue original image data of a pixel to YCbCr color space, and then calculating the luminance feature value TBP with the following:

$$TBP=0.299R+0.587G+0.114B.$$

5. The luminance adjustment method as claimed in claim 1, wherein each block comprises 3×3 pixels, the X-direction Sobel operator $Sobel_X$ and Y-direction Soble operator $Sobel_Y$ are respectively as:

$$Sobel_X=\begin{bmatrix}-1 & 0 & +1\\ -2 & 0 & +2\\ -1 & 0 & +1\end{bmatrix}$$

$$Sobel_Y=\begin{bmatrix}+1 & +2 & +1\\ 0 & 0 & 0\\ -1 & -2 & -1\end{bmatrix}.$$

6. The luminance adjustment method as claimed in claim 1, wherein calibration of the luminance adjustment coefficient of each block is performed as follows:

selecting a block, calculating a horizontal gain $K_H$ of an X-direction adjacent block, and a vertical gain $K_V$ of a Y-direction adjacent block for the selected block as follows:

$$K_H=K_1+(K_2-K_1)\times x/X;$$

$$K_V=K_1+(K_3-K_1)\times y/Y;$$

wherein $K_1$ is the luminance adjustment coefficient of the selected block, $K_2$ is the luminance adjustment coefficient of X-direction adjacent block of the selected block, $K_3$ is the luminance adjustment coefficient of Y-direction adjacent block of the selected block, x and y are X-direction and Y-direction coordinates of each pixel with respect to a center pixel of the selected block, X is the horizontal distance between the center pixel of the selected block and the center pixel of the X-direction adjacent block, and Y is the vertical distance between the center pixel of the selected block and the center pixel of the Y-direction adjacent block;

then, calculating the luminance adjustment calibration value K' of each pixel in the selected block as follows:

$$K'=(K_H+K_V)/2.$$

7. The luminance adjustment method as claimed in claim 6, wherein the modulated image data of each block is obtained as follows:

the modulated image data of a block=the luminance adjustment calibration value K' of each pixel in the block×the original image data of the corresponding pixel in the block, wherein:

$$R'=K'\times R;$$

$$G'=K'\times G;$$

$$B'=K'\times B;$$

wherein R', G', and B' are modulated red image data, modulated green image data, and modulated blue image data respectively.

8. A luminance adjustment method, comprising:

receiving original image data and dividing image into M×N blocks in X-direction and Y-direction; wherein M and N are both positive integers; each block comprising a plurality of pixels arranged in an array, the original image data of each pixel comprising: red original image data, green original image data, and blue original image data;

obtaining a luminance representative value for each block;

analyzing the original image data of each block to obtain an edge information amount of each block;

calculating a luminance adjustment coefficient of each block based on the luminance representative value and the edge information amount of each block;

performing calibration of the luminance adjustment coefficient of each block to obtain a luminance adjustment calibration value of each block so as to performing smooth processing on each pixel in each block to prevent luminance at borders between blocks from mutating; and performing modulation on the original image data based on the luminance adjustment calibration value of each block to obtain a modulated image data of each block so as to perform individual luminance modulation on each block;

wherein the luminance representative value of each block is obtained as follows:

obtaining a luminance feature value TBP of each pixel in a block; and calculating an average of the luminance feature values TBP of all the pixels in the block as the luminance representative value (average picture level, APL) of the block;

wherein Sobel operator is used for edge detection to obtain the edge information amount of each block;

wherein the edge information amount of each block is obtained as follows:

calculating an X-direction grayscale value $G_x$ and a Y-direction grayscale $G_Y$ of each pixel in a block:

$$G_X=\text{Sobel}_X\times f(a,b);$$

$$G_Y=\text{Sobel}_Y\times f(a,b);$$

wherein f(a,b) is the luminance value of the original image data corresponding to the pixel with X-direction coordinate a and Y-direction coordinate b in the block, $\text{Sobel}_X$ is an X-direction Sobel operator and $\text{Sobel}_Y$ is a Y-direction Soble operator;

calculating a gradient G of each pixel in the block:

$$G=\sqrt{G_X^2+G_Y^2};$$

comparing the gradient G of each pixel in the block with a default threshold; if the gradient G of a pixel being greater than the default threshold, determining the pixel as an edge point; and summing the number of the pixels determined as edge points in the block as the edge information amount of the block;

wherein each block comprises 3×3 pixels, the X-direction Sobel operator $\text{Sobel}_X$ and Y-direction Soble operator $\text{Sobel}_Y$ are respectively as:

$$Sobel_X=\begin{bmatrix}-1 & 0 & +1\\ -2 & 0 & +2\\ -1 & 0 & +1\end{bmatrix}$$

$$Sobel_Y=\begin{bmatrix}+1 & +2 & +1\\ 0 & 0 & 0\\ -1 & -2 & -1\end{bmatrix}$$

wherein the luminance adjustment coefficient of each block is calculated as follows:

presetting a target luminance for grayscale 255 at different luminance representative value APL so that the target luminance decreasing as the grayscale corresponding to the luminance representative value increasing, calculating a normal luminance adjustment coefficient $K_{APL}$ of each block as follows:

$$K_{APL}=\text{target luminance/luminance before adjustment};$$

presetting a relation between the edge information amount and an edge luminance adjustment coefficient $K_{edge}$, so that the edge luminance adjustment coefficient $K_{edge}$ decreasing as the edge information amount increasing, looking for the corresponding edge luminance adjustment coefficient $K_{edge}$ based on the edge information amount of each block;

calculating the luminance adjustment coefficient K as follows:

$$K=K_{APL}\times K_{edge}.$$

9. The luminance adjustment method as claimed in claim 8, wherein the luminance feature value TBP of each pixel in the block is obtained as follows:

extracting a maximum luminance value corresponding to the red original image data, green original image data, and blue original image data of a pixel as the luminance feature value TBP, which is:

$$TBP=\text{Max}(R,G,B).$$

10. The luminance adjustment method as claimed in claim 8, wherein the luminance feature value TBP of each pixel in the block is obtained as follows:

translating the red original image data, green original image data, and blue original image data of a pixel to YCbCr color space, and then calculating the luminance feature value TBP with the following:

$$TBP=0.299R+0.587G+0.114B.$$

11. The luminance adjustment system as claimed in claim 8, wherein calibration of the luminance adjustment coefficient of each block is performed as follows:

selecting a block, calculating a horizontal gain $K_H$ of an X-direction adjacent block, and a vertical gain $K_V$ of a Y-direction adjacent block for the selected block as follows:

$$K_H=K_1+(K_2-K_1)\times x/X;$$

$$K_V=K_1+(K_3-K_1)\times y/Y;$$

wherein $K_1$ is the luminance adjustment coefficient of the selected block, $K_2$ is the luminance adjustment coefficient of X-direction adjacent block of the selected block, $K_3$ is the luminance adjustment coefficient of Y-direction adjacent block of the selected block, x and y are X-direction and Y-direction coordinates of each pixel with respect to a center pixel of the selected block, X is the horizontal distance between the center pixel of the selected block and the center pixel of the X-direction adjacent block, and Y is the vertical distance between the center pixel of the selected block and the center pixel of the Y-direction adjacent block;

then, calculating the luminance adjustment calibration value K' of each pixel in the selected block as follows:

$$K'=(K_H+K_V)/2.$$

12. The luminance adjustment method as claimed in claim 11, wherein the modulated image data of each block is obtained as follows:

the modulated image data of a block=the luminance adjustment calibration value K' of each pixel in the block×the original image data of the corresponding pixel in the block, wherein:

$$R'=K'\times R;$$

$$G'=K'\times G;$$

$$B'=K'\times B;$$

wherein R', G', and B' are modulated red image data, modulated green image data, and modulated blue image data respectively.

* * * * *